US009850550B2

(12) United States Patent
Tsujita et al.

(10) Patent No.: US 9,850,550 B2
(45) Date of Patent: Dec. 26, 2017

(54) METHOD FOR RECOVERING SACCHARIDE FROM SACCHARIFIED SLURRY, AND WASHING DEVICE FOR WASHING RESIDUE

(71) Applicant: KAWASAKI JUKOGYO KABUSHIKI KAISHA, Kobe-shi, Hyogo (JP)

(72) Inventors: Shoji Tsujita, Itami (JP); Noriaki Izumi, Kobe (JP); Hironori Tajiri, Kobe (JP); Hiromasa Kusuda, Kobe (JP); Masaki Tsuzawa, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 345 days.

(21) Appl. No.: 14/758,410

(22) PCT Filed: Dec. 3, 2013

(86) PCT No.: PCT/JP2013/007086
§ 371 (c)(1),
(2) Date: Jun. 29, 2015

(87) PCT Pub. No.: WO2014/103184
PCT Pub. Date: Jul. 3, 2014

(65) Prior Publication Data

US 2015/0329925 A1 Nov. 19, 2015

(30) Foreign Application Priority Data

Dec. 27, 2012 (JP) ..... 2012-284973

(51) Int. Cl.
*C13B 20/16* (2011.01)
*C13K 1/04* (2006.01)

(52) U.S. Cl.
CPC ..... *C13B 20/16* (2013.01); *C13K 1/04* (2013.01)

(58) Field of Classification Search
CPC ..... C13B 20/16; C13K 1/04
See application file for complete search history.

(56) References Cited

FOREIGN PATENT DOCUMENTS

CN 2451627 Y 10/2001
JP 2010081855 A 4/2010
(Continued)

OTHER PUBLICATIONS

Translation of the Written Opinion for PCT/JP2013/007086, dated Jan. 2014.*

(Continued)

*Primary Examiner* — David A Reifsnyder
(74) *Attorney, Agent, or Firm* — Oliff PLC

(57) ABSTRACT

A saccharide recovering method for recovering saccharides from a saccharified slurry obtained after subjecting a slurry of cellulosic biomass to a hot water treatment and to provide a washing device for washing a saccharified slurry residue suited for conducting such a saccharide recovery method is provided. Saccharified slurry of cellulosic biomass is fed on a conveyor having a net conveyor belt, the saccharified slurry is dehydrated, washing water is sprayed to dissolve saccharides remaining in the residue into the washing liquid. The residue is washed by a plurality of washing water spraying units disposed in series in such a manner that the moving direction of the residue and the moving direction of the washing water are opposite to each other. The washing water having washed the residue is used as washing water for washing water spraying unit in the direction opposite to the moving direction of the conveyor.

12 Claims, 5 Drawing Sheets

(56) References Cited

FOREIGN PATENT DOCUMENTS

| | | | | |
|---|---|---|---|---|
| JP | 2010162461 | A | 7/2010 | |
| JP | 2010253348 | A | 11/2010 | |
| JP | WO 2014103184 | A1 * | 7/2014 | ..... C13K 1/04 |

OTHER PUBLICATIONS

Feb. 15, 2015 Office Action issued in Chinese Application No. 201310715648.2.

Jan. 21, 2014 International Search Report issued in International Application No. PCT/JP2013/007086.

* cited by examiner

METHOD FOR RECOVERING SACCHARIDE FROM SACCHARIFIED SLURRY, AND WASHING DEVICE FOR WASHING RESIDUE

TECHNICAL FIELD

The present invention relates to a method for recovering saccharides from a saccharified slurry in hydrolyzing cellulosic biomass in a supercritical state or subcritical state. The present invention also relates to a device for washing a solid residue (saccharified solution slurry residue) suited for conducting such a saccharide recovering method.

BACKGROUND ART

As part of utilization of biomass energy, attempts are made to obtain ethanol by decomposition of cellulose or hemicellulose which is a principal component of plants. In such attempts, they are planning to use the obtained ethanol for fuel by partly mixing it mainly in automotive fuel or by using it as an alternative fuel for gasoline.

Principal components of plants include cellulose (polymer of glucose which is C6 monosaccharide composed of six carbons), hemicellulose (polymer of C5 monosaccharide composed of five carbons and C6 monosaccharide), lignin, and starch. Ethanol is generated by fermentation action of microorganisms such as yeast from saccharides such as C5 saccharides including C5 monosaccharide, C6 saccharides including C6 monosaccharide and oligosaccharides which are complexes thereof as a source material.

For decomposition of cellulosic biomass such as cellulose or hemicellulose, the following three methods are planned to be industrially applied: 1) method of hydrolyzing by means of the oxidizing power of strong acid such as sulfuric acid, 2) method of enzymatically decomposing, and 3) method of utilizing the oxidizing power of supercritical water or subcritical water. However, in the acid decomposition method of 1) the added acid is an inhibitory substance for fermentation of yeast, and hence it is necessary to conduct a treatment of neutralizing the added acid before alcohol fermentation of saccharides after decomposition of cellulose or hemicellulose into saccharides, and this leads to difficulty in practical application for the economical reason in terms of the treatment cost. The enzymatic decomposition method 2) allows a treatment at a normal temperature and a constant pressure, however, an effective enzyme has not been found, and even if an effective enzyme is found, the production cost of the enzyme is probably high, and the prospects for industrial scale realization are still far from certain in the economical aspect.

As the method of hydrolyzing cellulosic biomass by supercritical water or subcritical water to produce saccharides of 3), Patent document 1 discloses a production method of saccharides capable of separating between saccharides containing C5 monosaccharide and C6 monosaccharide and saccharides containing C6 monosaccharide and recovering them, in addition to obtaining saccharides from wood biomass with high yield and high efficiency. The production method of saccharides of Patent document 1 includes: a first slurry heating step (S1) of heating a slurry prepared by adding high-temperature and high-pressure water to wood biomass; a first separating step (S2) of separating the heated slurry into a liquid ingredient and a solid ingredient a second slurry heating step (S3) of adding water to the separated solid ingredient to render it a slurry, and heating the slurry; a second separating step (S4) of separating the heated slurry into a liquid ingredient and a solid ingredient; and a useful ingredient achieving step (S5) of removing water from the separated liquid ingredient to achieve saccharides; and is characterized by further achieving saccharides by removing water from the liquid ingredient separated in the first separating step (S2) in addition to achieving saccharides in the useful ingredient achieving step (S5).

Patent document 2 discloses a method of hydrolyzing biomass that hydrolyzes biomass by the use of pressurized hot water, comprising: a first step of hydrolyzing mainly hemicellulose in the biomass; and a second step of hydrolyzing mainly cellulose in a residue obtained in the first step, wherein a liquid used in the first step includes a filtrate obtained by solid-liquid separation conducted after end of the second step. Patent document 2 also discloses to use, as a liquid for use in the hydrolysis of the first step, part of water that is recovered after washing a residue obtained by solid-liquid separation after end of the first step with water, together with the filtrate obtained by solid-liquid separation after end of the second step, and to use the remainder of the slurry in the second step.

On the other hand, as a device for conducting a dehydration treatment of an object to be dehydrated in the form of a slurry or a sludge, a belt type dehydrating device is known. For example, Patent Literature 3 discloses, as a filter cloth belt type dehydrating device capable of efficiently conducting a washing treatment of removing chlorine content from an object to be dehydrated with a simple structure, a filter cloth belt type dehydrating device having a filter cloth belt that is able to filter an object to be treated in the form of a slurry or a sludge and is wounded around in a endless manner and circled, wherein multiple stages of negative pressure dehydrating units each dehydrating the object to be dehydrated by action of suction negative pressure from the side of the bottom face of the filter cloth belt are disposed along the circling direction of the filter cloth belt, and a washing water overflow weir is provided above or above on the upstream side of at least one negative pressure dehydrating unit among the negative pressure dehydrating units of the second or later stage from the upstream side of the circling direction of the filter cloth belt, and curtain-like washing water flowing out from the washing water overflow weir is fed so that it reaches the full width of the object to be dehydrated on the filter cloth belt while the filter belt is continuously circled.

CITATION LIST

Patent Literature

PTL 1: JP 2010-81855 A
PTL 2: JP 2010-253348 A
PTL 3: JP 2010-162461 A

SUMMARY OF INVENTION

Technical Problem

Since C5 saccharides or C6 saccharides are dissolved in water after the slurry of cellulosic biomass is subjected to a hot water treatment, about 10 to 50 percent of C5 saccharides or C6 saccharides generated in the hot water treatment remain in a residue (dehydrated cake) obtained by a dehydration treatment. When the biomass concentration in the cellulosic biomass slurry is increased to improve the hydrolysis efficiency, the amount of C5 saccharides or the amount of C6 saccharides remaining in the residue after the hot water treatment increases, and it can occupy a half or larger of the generation amount in some cases. Therefore, it is desired to recover C5 saccharides or C6 saccharides from the dehydrated cake.

By washing the dehydrated cake, it is possible to recover C5 saccharides or C6 saccharides from the washing water. In an ordinary hydrolysis method, hemicellulose in biomass is subjected to a hot water treatment (first hot water treatment) and hydrolyzed to C5 saccharides, and the residue is subjected to a dehydration treatment, and the dehydrated cake (solid residue) is rendered a slurry again, and cellulose in biomass is hydrolyzed into C6 saccharides by a hot water treatment (second hot water treatment) under severer conditions. Therefore, it is preferred that the loss of the dehydrated cake due to washing is as small as possible.

Here, if the number of times of washing of the dehydrated cake is increased, or the washing water amount is increased, the saccharide recovery amount and the saccharide recovery from the dehydrated cake will increase. In such a case, however, a large quantity of washing water having low saccharide concentration is generated, so that the load in the concentration step for making the washing water to have a saccharide concentration suited for the fermentation step is excessive.

In addition, since it is necessary to dehydrate the dehydrated cake by a dehydrator after mixing the washing water and the dehydrated cake in washing the dehydrated cake, the operation efficiency is poor and long time is required for saccharide recovery, and rapid saccharide recovery is difficult to be conducted when the washing operation is conducted plural times.

It is an object of the present invention to provide a saccharide recovering method for recovering saccharides rapidly and easily from a saccharified slurry obtainable after subjecting a slurry of cellulosic biomass to a hot water treatment. It is also an object of the present invention to provide a device for washing a saccharified slurry residue suited for conducting such a saccharide recovering method.

Solution to Problem

The present inventors have made diligent efforts to solve the aforementioned problems, and have found that a saccharified slurry obtainable after subjecting a slurry of cellulosic biomass to a hot water treatment can be dehydrated easily by putting it on a netlike plane such as a metal mesh after addition of a flocculant. The present inventors also found that saccharides in the residue can be easily eluted in washing water by spraying the washing water to the residue remaining on the netlike plane (dehydrated slurry residue). Further, the present inventors have found that by using a net conveyor belt, it becomes easy to wash the residue on the net conveyor belt plural times with washing water, and then conduct dehydration, and finally accomplished the present invention.

Concretely, the present invention relates to a method for recovering saccharides from a saccharified slurry, including:

a washing step of feeding a saccharified slurry containing C5 saccharides or C6 saccharides obtained by subjecting a slurry of cellulosic biomass to a hot water treatment in a supercritical state or subcritical state, on a conveyor having a net conveyor belt, dehydrating the saccharified slurry and spraying washing water to a dehydrated residue on the conveyor to dissolve C5 saccharides or C6 saccharides remaining in the residue in a washing liquid, wherein the washing step washes the residue by spraying washing water to the residue from a plurality of washing water spraying units disposed in series in such a manner that the moving direction of the residue and the moving direction of the washing water are opposite to each other; and the washing water having washed the residue is used as washing water of a washing water spraying unit neighboring in the direction opposite to the moving direction of the conveyor.

By feeding the saccharified slurry obtained after subjecting a slurry of cellulosic biomass to a hot water treatment on the net conveyor belt, the water drops downward from the net conveyor belt, and the saccharified slurry can be dehydrated rapidly.

The solid residue of the dehydrated saccharified slurry is moved by the net conveyor belt, and by spraying the washing water sequentially from the plurality of washing water spraying units to the residue so that the washing water is a counter flow, it is possible to wash the residue of the solid content with the washing water, and to efficiently recover saccharides from the solid residue. Since the sprayed washing water drops downward from the net conveyor belt, it is possible to increase the recovery amount of saccharides form the solid residue with little washing water by supplying the sprayed washing water to the washing water spraying unit neighboring in the direction opposite to the moving direction of the solid residue (conveyor conveyance direction). By increasing the thickness of the solid residue on the net conveyor belt, it is possible to increase the washing effect.

Preferably, an adding step of adding a flocculant to the saccharified slurry is further provided before the washing step.

By adding the flocculant to the saccharified slurry obtainable after subjecting a slurry of cellulosic biomass to a hot water treatment, the solid content in the saccharified slurry forms a floc. Thereafter, by feeding the saccharified slurry on the net conveyor belt, it is possible to dehydrate the saccharified slurry more rapidly.

Preferably, the net conveyor belt has a mesh ranging from 0.5 mm or more and 2.0 mm or less.

When the mesh is less than 0.5 mm, the water dehydrated from the saccharified slurry fails to drop rapidly from the net conveyor belt, and the dehydration can be insufficient. On the other hand, when the mesh is larger than 2.0 mm, part of the solid residue can fall off from the net conveyor belt together with the washing water.

Preferably, the number of the washing water spraying units is five or mote and twenty or less.

When the number of the washing water spraying units is four or less, saccharide recovery from the solid residue can be insufficient. On the other hand, disposing 21 or more washing water spraying units is problematic in the economical view. Practically, five or more and ten or less is more preferred.

Preferably, in the adding step, any one or any combination of two or more of a cationic flocculant, an anionic flocculant, a nonionic flocculant and an amphoteric flocculant is added at 0.1% by mass or higher and 2% by mass or lower with respect to a solid content of the saccharified slurry.

When the flocculant added to the saccharified slurry is less than 0.1% by mass with respect to the solid content of the saccharified slurry, flocculation is insufficient, and the solid in the saccharified slurry is difficult to form a floc. On the other hand, when it exceeds 2% by mass with respect to the solid content of the saccharified slurry, the problem arises that the cost of adding the flocculant increases, and the running cost rises. When the particle size of the solid in the saccharified slurry is large, the saccharide recovering method of the present invention can be conducted without using a flocculant.

The present invention also relates to a washing device that washes a solid residue in a saccharified slurry containing C5 saccharides or C6 saccharides obtained by subjecting a slurry of cellulosic biomass to a hot water treatment in a supercritical state or subcritical state, the washing device including:

a conveyor having a net conveyor belt;

a plurality of spraying units disposed in series on the net conveyor belt; and a plurality of water storage tanks disposed below the net conveyor so that they are situated below the respective spraying units;

the washing device feeding a saccharified slurry on the net conveyor belt, dehydrating the saccharified slurry, and then spraying washing water to the residue on the net conveyor belt from the spraying unit, thereby washing the residue, wherein one of the water storage tanks is connected with one spraying unit neighboring in the direction opposite to a moving direction of the conveyor by piping, and the water storage tank stores water sprayed from the spraying unit disposed directly above, and the stored water is repeatedly used sequentially in the spraying unit neighboring in the direction opposite to the moving direction of the conveyor via a pump and piping to continuously wash the residue.

Preferably, the number of the spraying units is five or more and twenty or less.

The present invention also relates to a washing device that washes a solid residue in a saccharified slurry containing C5 saccharides or C6 saccharides obtained by subjecting a slurry of cellulosic biomass to a hot water treatment in a supercritical state or subcritical state, the washing device including:

a conveyor having a net conveyor belt;

a plurality of water storage tanks; and a washing water spraying unit, the washing device feeding a saccharified slurry on the net conveyor belt, dehydrating the saccharified slurry, and then spraying washing water to the residue on the net conveyor belt, thereby washing the residue, wherein the plurality of water storage tanks are sequentially stacked at different heights in such a manner that part of the water storage tank neighboring in the direction opposite to a moving direction of the conveyor is lower, the net conveyor belt turns around so as to pass through the top face of every water storage tank from the water storage tank situated at the lowest position to the water storage tank situated at the highest position, and the plurality of water storage tanks store washing water sprayed on the net conveyor belt from the washing water spraying unit disposed above the water storage tank situated at the highest position, and repeatedly sprays the stored washing water sequentially on the net conveyor belt above the water storage tank neighboring in the direction opposite to the moving direction of the conveyor, thereby continuously washing the residue.

Preferably, the number of the plurality of water storage tanks is five or more and twenty or less.

Advantageous Effects of Invention

According to the saccharide recovering method from a saccharified slurry of the present invention, it is possible to recover saccharides efficiently with a less amount of washing water in comparison with the conventional saccharide recovering method that dehydrates a saccharified shiny by a dehydrator and washes the dehydrated cake with washing water, and the load in the subsequent concentration step is small.

DESCRIPTION OF EMBODIMENTS

Hereinafter, preferred embodiments of the present invention will be explained in reference to the drawings. The present invention is not limited to the following description.

Embodiment 1

Figure 1:
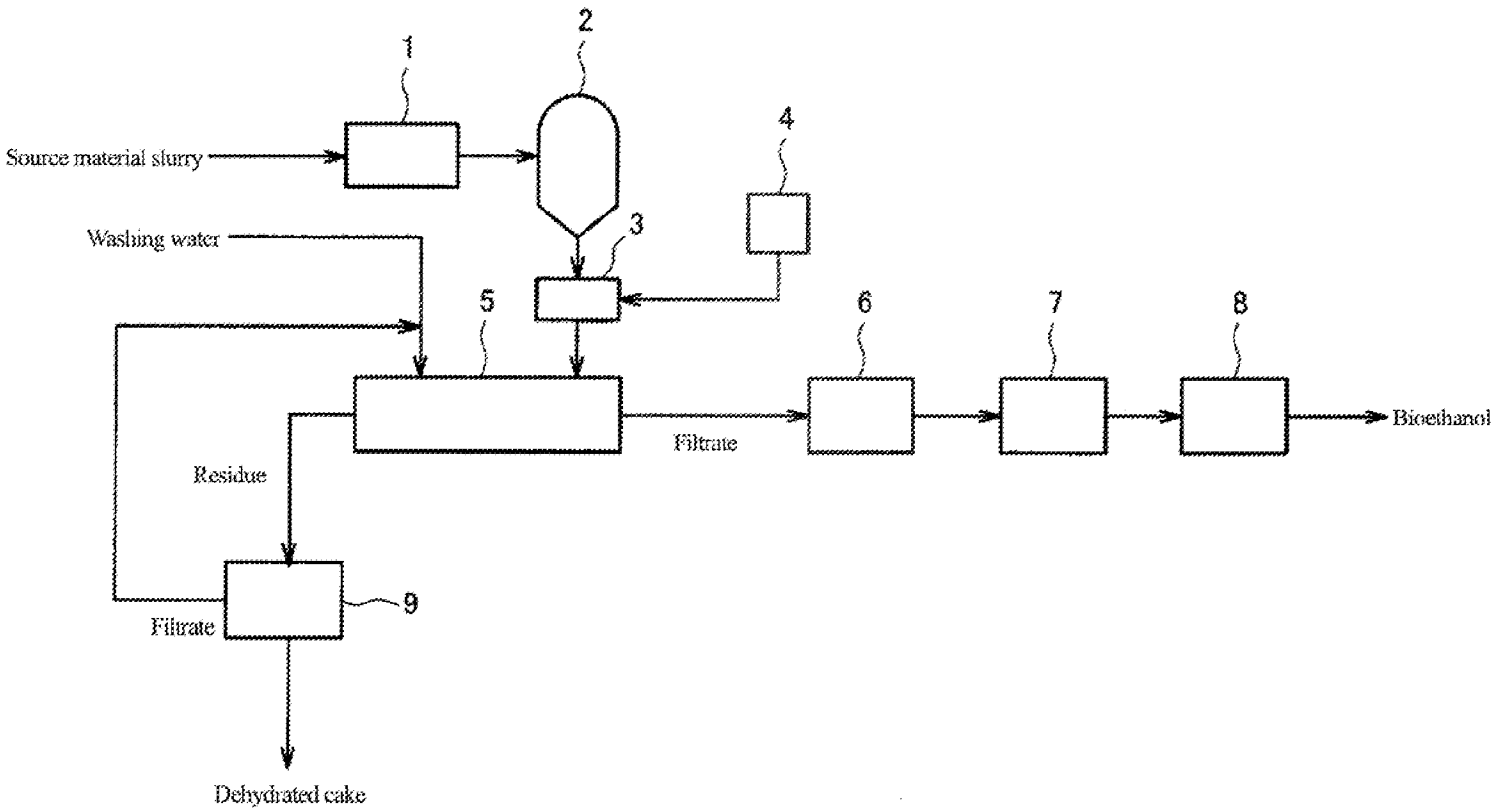
FIG. 1 is a schematic flowchart showing one example of an ethanol producing method that uses biomass as a source material utilizing a method for recovering saccharides from a saccharified slurry of the present invention.

FIG. 1 is a schematic flowchart showing one example of an ethanol producing method that uses biomass as a source material utilizing a method for recovering saccharides from a saccharified slurry of the present invention.

(Preparation of Source Material Slurry)

First of all, cellulosic biomass (vegetation biomass such as bagasse, beet dregs, or straw) is ground to several millimeters or smaller as a pretreatment. The ground cellulosic biomass is mixed with water and stirred to produce a slurry. The water content of the prepared source material slurry is preferably adjusted to 50% by mass or higher and 95% by mass or lower. To the source material slurry, acid such as sulfuric acid, hydrochloric acid, nitric acid, phosphoric acid or acetic acid may be appropriately added as an acid catalyst. In this case, the acid concentration in the source material slurry is preferably adjusted to 0.1% by mass or higher and 10% by mass or lower.

(Saccharification and Decomposition of Cellulose and/or Hemicellulose)

The source material shiny is fed into a pressure vessel 1 after it is preheated as is necessary. A non-limiting concrete example of the pressure vessel 1 is an indirect heating pressure vessel. In the case of saccharifying and decomposing hemicellulose, the source material slurry is subjected to a hot water treatment at a temperature ranging from 140° C. or higher and 200° C. or lower, and under a pressure ranging from 1 MPa or higher and 5 MPa or lower in the pressure vessel 1. By this hot water treatment, hemicellulose in the cellulosic biomass is saccharified and decomposed (hydrolyzed) into C5 saccharides. In the case of saccharifying and decomposing cellulose, the source material slurry is subjected to a hot water treatment at a temperature ranging from 240° C. or higher and 300° C. or lower, and under a pressure ranging from 4 MPa or higher and 10 MPa or lower in the pressure vessel 1. By this hot water treatment, cellulose in the cellulosic biomass is hydrolyzed into C6 saccharides.

Preferably, after conduction of a hot water treatment for a certain time, the slurry (saccharified slurry) is fed to a flush tank 2 from the pressure vessel 1, and the saccarified slurry is rapidly cooled to a temperature less than the subcritical state through flush evaporation to thereby stop the saccharification reaction.

(Adding Step)

The saccharified slurry taken out from the flush tank 2 is fed to a mixing tank 3. To the mixing tank 3, a solution containing one or combination of two or more of a cationic flocculant, an anionic flocculant, a nonionic flocculant and an amphoteric flocculant is fed from a flocculant tank 4, and mixed with the saccharified slurry. Preferably, one or combination of two or more of a cationic flocculant, an anionic flocculant, a nonionic flocculant and an amphoteric flocculant is added to the saccharified slurry so that its concentration with respect to the solid content in the saccharified slurry is 0.1% by mass or higher and 2% by mass or lower. The kind of the flocculant is not particularly limited. By adding the flocculant, solids in the saccharified slurry form a floc.

(Washing Step)

The saccharified slurry to which the flocculant is added is fed to a residue washing device 5, and fed onto a net conveyor belt of a conveyor having the net conveyor belt. The saccharified slurry to which the flocculant is added has a water content of about 90% by mass, and is rapidly dehydrated to have a water content of about 80 to 90% by mass by downward dropping of water from the net conveyor belt. Since the dehydration is conducted merely by means of the net conveyor belt, a vacuum pump or a blower for pressurization is not required, and the cost of equipment is low in contrast with a dehydrating method using a belt filter.

Figure 2:
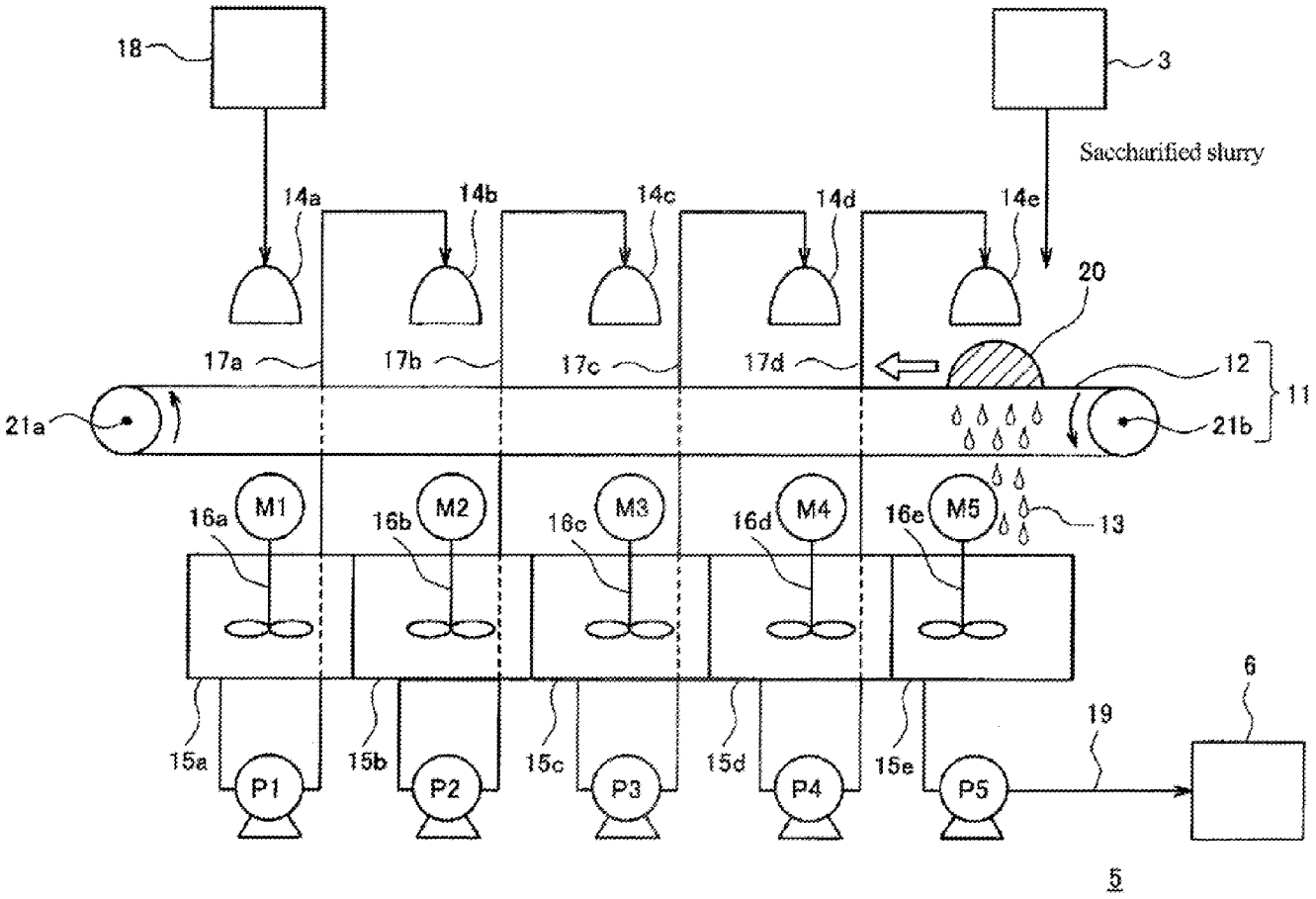
FIG. 2 is a block diagram showing one example of a residue washing device of Embodiment 1.

FIG. 2 illustrates one example of the residue washing device 5 including a conveyor 11 having a net conveyor belt (Embodiment 1). The residue washing device 5 includes the conveyor 11, washing water spraying unit 14*a* to 14*e*, and water storage tanks 15*a* to 15*e*. The water storage tanks 15*a* to 15*e* am disposed directly below the washing water spraying units 14*a* to 14*e*. The water storage tanks 15*a* to 15*e* are respectively provided with stirrers 16*a* to 16*e* rotated by motors MI to MS. The water storage tanks 15*a* to 15*d* are respectively connected with the washing water spraying units 14*b* to 14*e* by pipings 17*a* to 17*d*. The washing water spraying unit 14*a* is connected with a washing water tank 18. The water storage tank 15*e* is connected with a concentrating device 6 by piping 19.

As the saccharified slurry to which the flocculant is added, which is taken out from the mixing tank 3 is dropped on a net conveyor belt 12, water 13 drops downward through the net conveyor belt 12. As a result, the saccharified slurry is dehydrated, and a residue 20 remains on the net conveyor belt 12. The water is stored in the directly underlying water storage tank 15*e*.

In the conveyor 11, since rotation axes 21*a* and 21*b* of the net conveyor belt 12 rotate counterclockwise, the net conveyor belt 12 turns around in such a manner that its upper face moves from right to left. Therefore, the residue 20 moves from right to left in the diagram.

Figure 3:
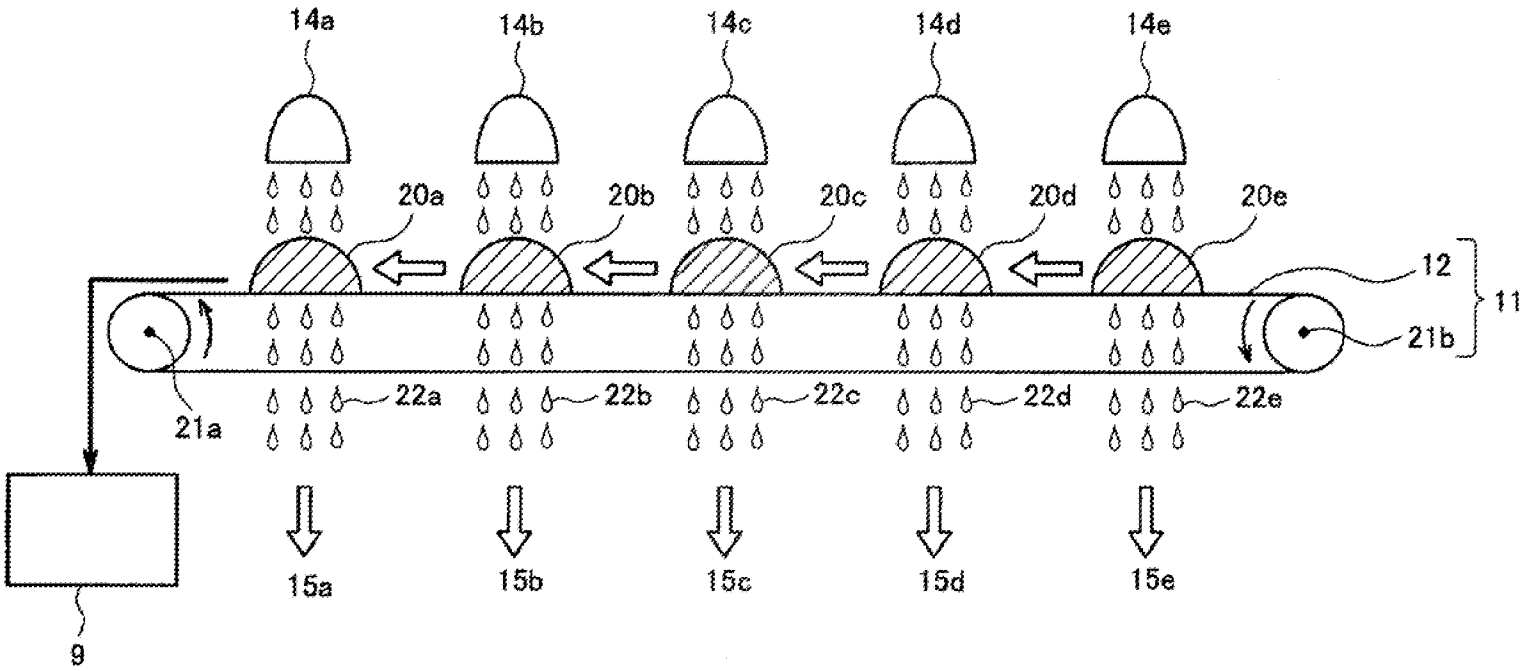
FIG. 3 is a conceptual diagram illustrating a method for washing a residue by the residue washing device of Embodiment 1.

Next, a method of washing the residue 20 in a steady state of the residue washing device 5 illustrated in FIG. 2 will be described by referring to FIG. 3. The residue 20 on the net conveyor belt 12 sequentially moves in the direction of 20*e*→20*d*→20*c*→20*b*→20*a*. A residue 20*a* is sprayed with washing water that is fed from the washing water tank 18, from the washing water spraying unit 14*a*. Non-limiting concrete examples of washing water include tap water, industrial water, purified water, deionized water and condensed water. The residue 20*a* is washed with the washing water sprayed from the washing water spraying unit 14*a*, and the remaining saccharides (C5 saccharides and C6 saccharides) are dissolved in the washing liquid. Washing water 22*a* containing saccharides is stored in the water storage tank 15*a*. The washed residue 20*a* is washed five times by the washing water spraying units 14*a* to 14*e*, and then fed to a dehydrator 9 from the conveyor 11.

The washing water stored in the water storage tank 15*a* is stirred by the stirrer, 16*a*, and then fed to the washing water spraying unit 14*b* via a pump P1 and the path 17*a* as illustrated in FIG. 2. Then a residue 20*b* is sprayed with washing water from the washing water spraying unit 14*b*. The residue 20*b* is washed with the washing water sprayed from the washing water spraying unit 14*b*, and the remaining saccharides are dissolved in the washing liquid. Washing water 22*b* containing saccharides is stored in the water storage tank 15*b*.

Also regarding residues 20*c* to 20*e*, similarly to the residue 20*b*, washing water is sprayed from the washing water spraying units 14*c* to 14*e* in such a manner that the moving direction of the residue and the moving direction of the washing water are opposite to each other. The washing water sprayed to the residue 20*e* from the washing water spraying unit 14*e* dissolves the saccharides remaining in the residue 20*e* to become a washing liquid 22*e* containing saccharides, and is stored in the water storage tank 15*e*. Then it is stirred with the water 13 having dropped first, and is fed to the concentrating device 6 via a pump P5 and the piping 19.

As described above, in the present invention, the residue 20*a* to 20*e* are washed with washing water sprayed from the washing water spraying units 14*a* to 14*e* in such a manner that the moving direction of the residue and the moving direction of the washing water are opposite to each other. That is, the moving direction of the residue 20 is 20*e*→20*d*→20*c*→20*b*→20*a*, and the moving direction of the washing water is 14*a*→14*b*→14*c*→14*d*→14*e*. The washing water having washed the residue 20 is used as washing water of the washing water spraying unit neighboring on the side opposite to the conveyor moving direction (the washing water spraying unit neighboring on the right in FIG. 2 and FIG. 3). Since the residue containing a small residual amount of saccharides is washed with washing water having low saccharide concentration, saccharides can be recovered efficiently from the residue 20.

Further, since washing water in which saccharides are dissolved is reused, the amount of washing water fed to the concentrating device 6 is reduced in comparison with the conventional method of washing a dehydrated cake with washing water, and the load of the concentration step can be reduced. Further, since the residue washing operation is conducted in the conveyor 11, the washing operation can be conducted continuously. Accordingly, it is also possible to reduce the time required for the washing step in comparison with a conventional saccharide recovering method in which washing and dehydration of a dehydrated cake are repeated.

The residue 20 fed to the dehydrator 9 is separated into a dehydrated cake and a filtrate (washing liquid). Non-limiting concrete examples of the dehydrator 9 include a drum filter, a belt filter, a disc filter, a filter press and a decanter. The dehydrated cake may be rendered a slurry again and fed to another saccharifying and decomposing step, or may be disposed of, if unnecessary. On the other hand, the filtrate may be used as part of the washing water fed to the residue washing device 5 as illustrated in FIG. 1 because a small amount of saccharides is dissolved therein.

(Concentration Step)

The washing water (including the water 13 separated first from the saccharified slurry) fed to the concentrating device 6 is concentrated so that the concentration of saccharides is 10% by mass or higher that is suited for alcoholic fermentation by yeast. Non-limiting concrete examples of the concentrating device 6 include a reverse osmosis membrane device and a distillation device.

Preferably, the washing water is stored in a thickener to remove a sediment before it is fed to the concentrating device 6. By removing the sediment, soiling of the concentrating device 6 can be prevented. To the thickener, it is preferred to add either one or a combination of two or more of a cationic flocculant, an anionic flocculant, a nonionic flocculant and an amphoteric flocculant so that its concentration relative to the solid content in the thickener is 0.1% by mass or higher and 2% by mass or less. The sediment recovered from the thickener may be fed to the mixing tank 3 and thus the flocculant added to the mixing tank 3 may be reduced.

(Fermentation Step)

The washing water (saccharified solution) concentrated by the concentrating device 6 is fed to a fermentation tank 7. In the fermentation tank 7, saccharides (C5 saccharides and C6 saccharides) are converted to ethanol by the use of yeast. In the fermentation step, a known alcohol fermentation method can be employed.

(Distillation Step)

Next, the alcoholic fermented solution after the fermentation step is fed to a distillation device 8, and ethanol is concentrated. In the distillate obtained in the distillation step, ingredients other than the solid and ethanol have been removed. In the distillation step, a known distillation step that is known as a production method of distilled liquor can be employed.

Embodiment 2

Figure 4:
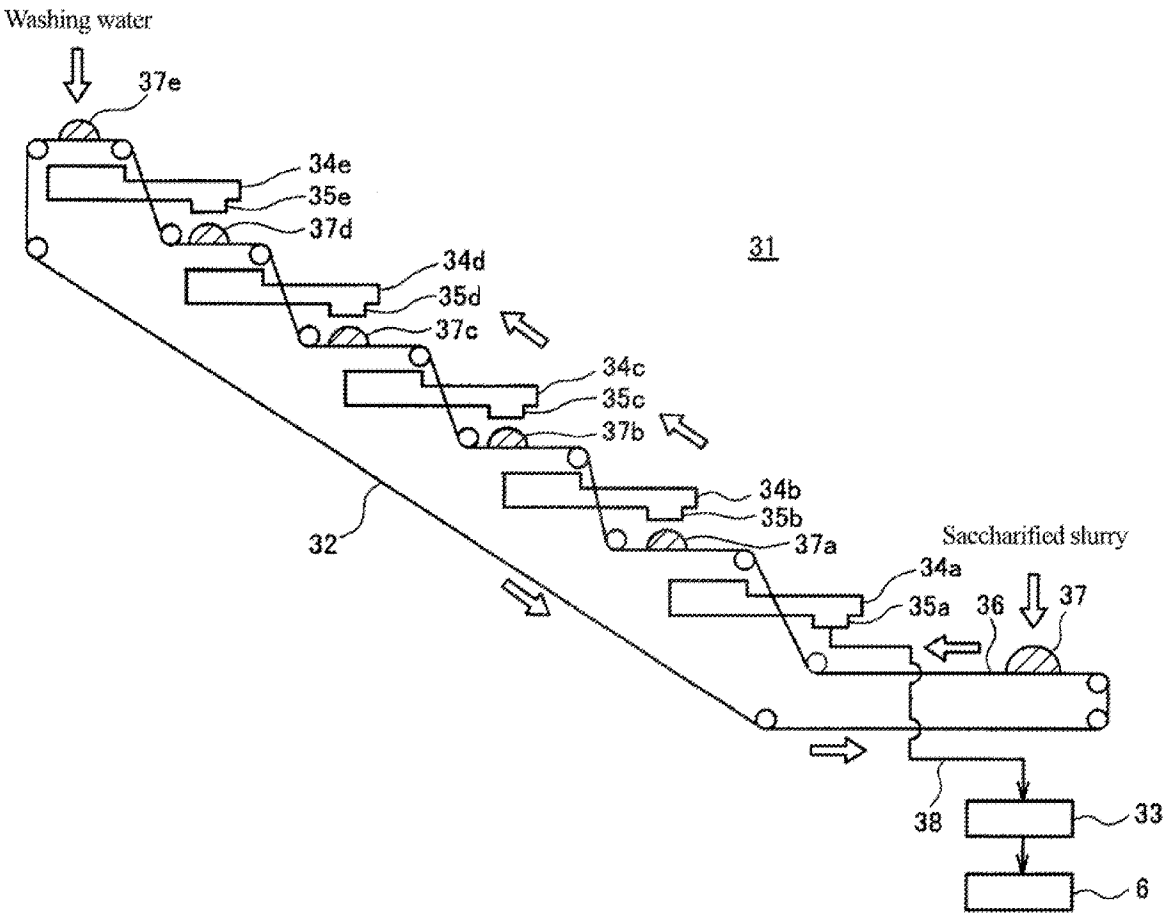
FIG. 4 is a block diagram showing one example of a residue washing device of Embodiment 2.
Figure 5:
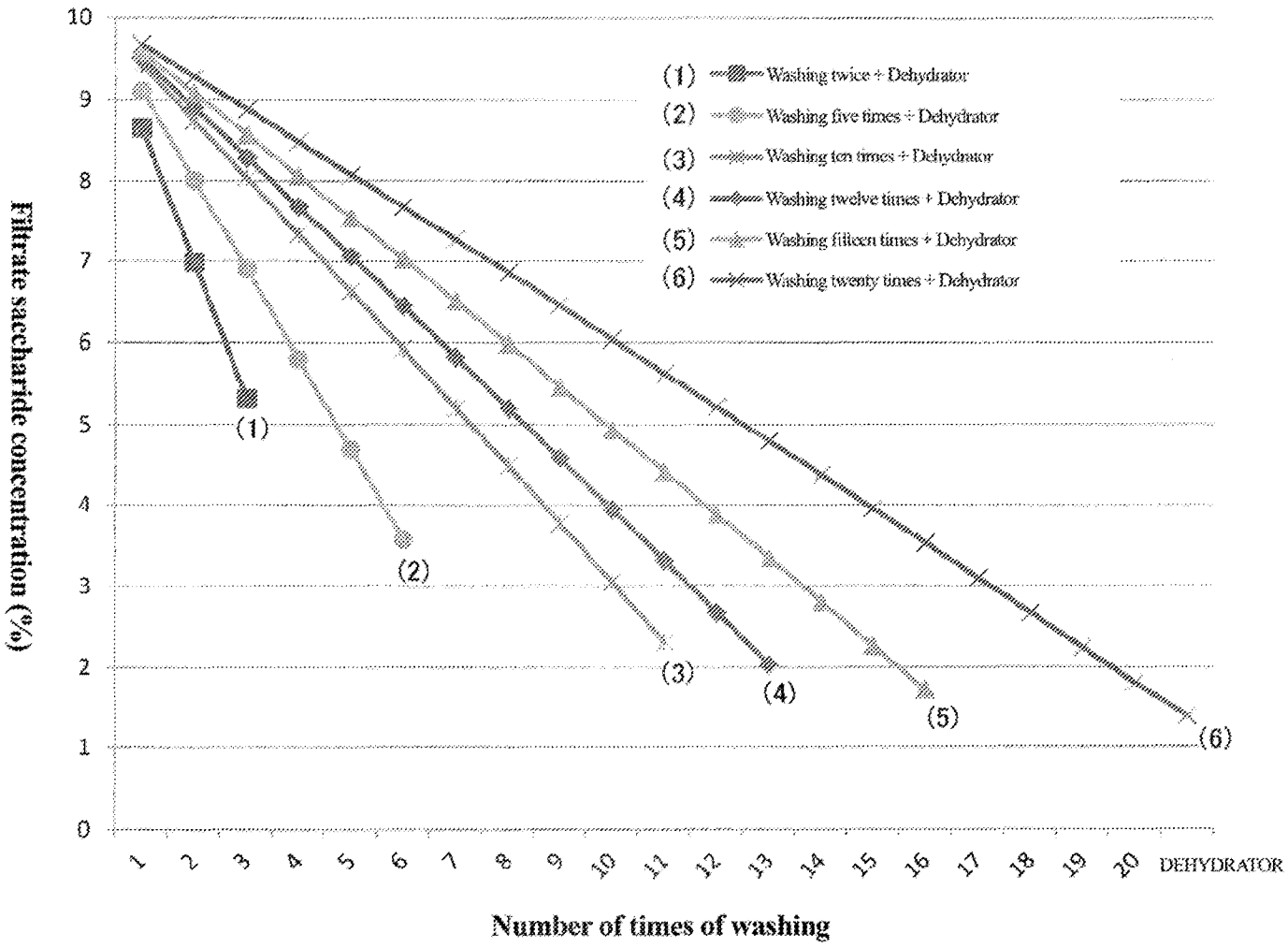
FIG. 5 is a graphical representation of the relationship between the number of times of washing of the residue and the saccharide concentration of the filtrate (washing water that is sprayed to the residue and recovered) in a simulation regarding the saccharide recovering method of Embodiment 1.

FIG. 4 illustrates one example of a residue washing device including a conveyor having a net conveyor belt (Embodiment 2). A residue washing device 31 illustrated in FIG. 4 includes a conveyor 32, a water storage tank 33, and water storage troughs (water storage tanks) 34*a* to 34*e*, and sprinkling ports 35*a* to 35*e* situated in bottom parts of the water storage trough 34*a* to 34*e* function as a sprinkler. A net conveyor belt 36 turns around in the counterclockwise direction. A saccharified slurry is fed to the position indicated as a residue 37 in FIG. 4, and water is stored in the water storage tank 33 situated directly below the residue 37. The residue 37 sequentially moves on the net conveyor belt 36 in the direction from the lower right to the upper left in the diagram.

Next, a washing method of the residue 37 in a steady state of the residue washing device 31 illustrated in FIG. 4 will be described. Here, only differences from the residue washing device 5 illustrated in FIG. 2 and FIG. 3 will be described. The moving direction of the residue 37 on the net conveyor belt 36 is 37→37*a*→37*b*→37*c*→37*d*→37*e*. When there is a residue 37*e* on the net conveyor belt 36 above the water storage trough 34*e* at the uppermost stage, washing water is sprayed from a washing water spraying unit (not illustrated) situated above the residue 37*e*. The residue 37*e* is washed with the washing water sprayed from the washing water spraying unit, and the remaining saccharides (C5 saccharides and C6 saccharides) are dissolved in the washing liquid. The washing water containing saccharides passes through the net conveyor belt 36, and is stored in the water storage trough 34*e*.

In a bottom part of the water storage trough 34*e*, the sprinkling port 35*c* is disposed, and the stored washing liquid is sprayed to a residue 37*d* on the net conveyor belt 36 at a lower stage. The residue 37*d* is washed with the washing water sprayed from the sprinkling ports 35*e*, and the remaining saccharides are dissolved in the washing liquid. The washing water containing saccharides passes through the net conveyor belt 36, and is stored in the water storage tough 34*d*.

Also regarding the residues 37*c* to 37*a*, washing water is sprayed from the sprinkling ports 35*d* to 35*b*, respectively as is the case with the residue 37*d*. The washing water sprayed to the residue 37*a* is stored in the water storage trough 34*a*, and then stored in the water storage tank 33 via piping 38 connected with the sprinkling port 35*a*. Then, the washing water in the water storage tank (including water separated from the residue 37 of the saccharified slurry) is fed to the concentrating device 6.

In the residue washing device 31 illustrated in FIG. 4, the moving direction of the residue 37 is 37→37*a*→37*b*→37*c*→37*d*→37*e*, and the moving direction of the washing water is 35*d*→35*c*→35*b*→35*a*. That is, the moving direction of the residue and the moving direction of the washing water are opposite to each other. In contrast to the residue washing device 5, the residue washing device 31 is advantageous in that a pump and piping for feeding washing water to the washing water spraying unit from the water storage tank can be omitted.

<Simulation of Saccharide Recovery>

Assuming that the flow rate and the solid concentration of a source material slurry are 100 t/h and 10% by mass, respectively and the saccharide concentration of a saccharified slurry is 10% by mass (concentration in the liquid), the saccharide flow rate is calculated as 9 t/h.

(Conventional Art)

Saccharide recovery in the case of dehydrating a saccharified slimy by a dehydrator and recovering the filtrate under the above assumption was simulated. Assuming that the solid concentration of the dehydrated cake is 30% by mass, the flow rate of the dehydrated cake is 33.31/h, and the saccharide flow rate of the saccharide liquid remaining in the dehydrated cake is 2.33 t/h. The saccharide flow rate of the filtrate is 6.67 t/h, and the saccharide recovery is calculated as 6.67/9×100=74.1%.

Next, saccharide recovery in the case of adding washing water to the dehydrated cake at a flow rate of 23 t/h to give a shiny again, and dehydrating the slurry again by a dehydrator and recovering the filtrate was simulated. Since the filtrate of the second dehydrator contains saccharides at a flow rate of 1.03 t/h, we assumed that the filtrate returned to the saccharified slurry before being put into the dehydrator and mixed them. The mixture that is rendered a slurry again has a flow rate of 56 t/h, a solid concentration of 18% by mass, a saccharide concentration of 4.47% by mass, and a saccharide flow rate of 2.07 t/h. The flow rate of the second dehydrated cake is 33 t/h, and the saccharide flow rate of the saccharide liquid remaining in the dehydrated cake is 1.04 t/h. The saccharide flow rate of the second filtrate is 1.03 t/h. Saccharide recovery integrated from the first filtrate is calculated as (9−1.04)/9×100=88.4%

Next, using five dehydrators, the dehydrated cake was washed four times in the same manner as described above, and the saccharide recovery integrated from the first filtrate was calculated as 94.9%. However, the dehydrator is determined as not being practical because it is expensive, and raises the cost of equipment although it achieves high saccharide recovery.

(Present Invention)

Next, regarding the saccharide recovering method of Embodiment 1, the saccharide recovery from the washing water was simulated under the same assumption as described above. Twelve washing water spraying units were disposed in series, and the filtrate flow rate was assumed as 73 t/h every time. The solid concentration of the residue on the net conveyor belt was assumed as 12% by mass. The saccharide concentration and the saccharide flow rate of the residue washed twelve times were calculated as 2.67% by mass and 1.96 t/h, respectively. The saccharide flow rate of the twelfth washing water (filtrate) was calculated as 1.95 t/h. Assuming that the residue after twelve washings is mixed with washing water (not containing saccharides) at a flow rate of 23 t/h, and filtrated by a dehydrator, the filtrate of the dehydrator is calculated to have a flow rate of 73 t/h, a saccharide concentration of 2.04% by mass, and a saccharide flow rate of 1.49 t/h. The flow rate of the dehydrated cake is 33 t/h, and the saccharide flow rate of the saccharide liquid remaining in the dehydrated cake is 0.47 t/h. The filtrate of the dehydrator is assumed to be used as the residue washing water of the twelfth time. The saccharide recovery from the filtrate (washing water) by the residue washing device under this assumption was calculated as $(9-0.47)/9\times 100=94.7\%$.

As described above, the saccharide recovering method of Embodiment 1 showed high saccharide recovery comparable with that by the conventional saccharide recovering method that recovers saccharides from a dehydrated cake by using five dehydrators. The cost of one residue washing device having twelve washing water spraying units is comparable with the cost of one dehydrator. This leads to the consideration that according to the present invention it is possible to recover saccharides efficiently with lower costs compared to the conventional saccharide recovering method according to the present invention.

Table 1A and Table 1B show the relationship between the number of times of washing of the residue and the saccharide concentration of the filtrate (washing water that is sprayed to the residue and recovered) in the aforementioned simulation regarding the saccharide recovering method of Embodiment 1. As shown in Table 1A and Table 1B, the saccharide concentration of the filtrate of the first time washing was 9.68% by mass in the case of the residue washing device that executes washing twenty times (namely, the residue washing device having twenty washing water spraying units). The saccharide concentration of the filtrate of the second time washing decreased to 9.28% by mass, and the saccharide concentration of the filtrate decreased as the number of times of washing increased. And the saccharide concentration in the liquid contained in the dehydrated cake decreased to 1.38% by mass.

Among the residue washing devices that were performed at the numbers of times of washing of 2, 5, 10, 12, 15 and 20, the saccharide concentrations contained in the liquid amount differ from each other, as evidenced by 5.32% by mass, 3.57% by mass, 232% by mass, 2.04% by mass, 1.73% by mass and 1.38% by mass, although the liquid amounts contained in the respective dehydrated cakes are identical. This proved that the remaining saccharide in the dehydrated cake reduces as the number of times of washing of the residue washing device increases. Accordingly, as shown in Table 2A and Table 2B that will be later described, the saccharide recovery increases as the number of times of washing of the residue washing device increases.

It was revealed that when the number of times of washing (namely, the number of washing water spraying units) is five or more, the saccharide concentration of the filtrate of the first washing exceeds 9% by mass, and when the number of times of washing is ten or more, it is as high as about 9.4% by mass or more, and the load of the concentrating device of the subsequent stage can be reduced.

TABLE 1A

| | Saccharide concentration in filtrate at each number of times of washing (% by mass) | | | | | | | | | | | |
|---|---|---|---|---|---|---|---|---|---|---|---|---|
| | First time | Second time | Third time | Fourth time | Fifth time | Sixth time | Seventh time | Eighth time | Ninth time | Tenth time | Eleventh time | Twelfth time |
| Second time washing | 8.65 | 6.99 | — | — | — | — | — | — | — | — | — | — |
| Fifth time washing | 9.11 | 8.01 | 6.91 | 5.80 | 4.69 | — | — | — | — | — | — | — |
| Tenth time washing | 9.43 | 8.74 | 8.04 | 7.33 | 6.63 | 5.92 | 5.20 | 4.49 | 3.77 | 3.04 | — | — |
| Twelfth time washing | 9.51 | 8.90 | 8.29 | 7.68 | 7.06 | 6.44 | 5.82 | 5.20 | 4.57 | 3.94 | 3.31 | 2.67 |
| Fifteenth time washing | 9.59 | 9.08 | 8.57 | 8.06 | 7.54 | 7.03 | 6.51 | 5.99 | 5.46 | 4.94 | 4.41 | 3.87 |
| Twentieth time washing | 9.68 | 9.28 | 8.88 | 8.48 | 8.08 | 7.67 | 7.27 | 6.86 | 6.45 | 6.04 | 5.62 | 5.21 |

TABLE 1B

| | Saccharide concentration in filtrate at each number of times of washing (% by mass) | | | | | | | | Saccharide concentration in liquid content remaining in |
|---|---|---|---|---|---|---|---|---|---|
| | Thirteenth time | Fourteenth time | Fifteenth time | Sixteenth time | Seventeenth time | Eighteenth time | Nineteenth time | Twentieth time | dehydrated cake (% by mass) |
| Second time washing | — | — | — | — | — | — | — | — | 5.32 |
| Fifth time washing | — | — | — | — | | — | — | — | 3.57 |

TABLE 1B-continued

| | Saccharide concentration in filtrate at each number of times of washing (% by mass) | | | | | | | | Saccharide concentration in liquid content remaining in |
|---|---|---|---|---|---|---|---|---|---|
| | Thirteenth time | Fourteenth time | Fifteenth time | Sixteenth time | Seventeenth time | Eighteenth time | Nineteenth time | Twentieth time | dehydrated cake (% by mass) |
| Tenth time washing | — | — | — | — | | — | — | — | 2.32 |
| Twelfth time washing | — | — | — | — | | — | — | — | 2.04 |
| Fifteenth time washing | 3.34 | 2.80 | 2.27 | — | | — | — | — | 1.73 |
| Twentieth time washing | 4.79 | 4.37 | 3.95 | 3.53 | 3.10 | 2.67 | 2.24 | 1.81 | 1.38 |

Table 2A and Table 2B show the relationship between the number of times of washing of the residue and the saccharide flow rate of the filtrate in the above simulation regarding die saccharide recovering method of Embodiment 1.

TABLE 2A

| | Saccharide flow rate of filtrate at each number of times of washing (t/h) | | | | | | | | | | | |
|---|---|---|---|---|---|---|---|---|---|---|---|---|
| | First time | Second time | Third time | Fourth time | Fifth time | Sixth time | Seventh time | Eighth time | Ninth time | Tenth time | Eleventh time | Twelfth time |
| Second time washing | 7.76 | 5.10 | — | — | — | — | — | — | — | — | — | — |
| Fifth time washing | 8.17 | 5.85 | 5.04 | 4.23 | 3.42 | — | — | — | — | — | — | — |
| Tenth time washing | 8.46 | 6.38 | 5.87 | 5.35 | 4.84 | 4.32 | 3.80 | 3.27 | 2.75 | 2.22 | | — |
| Twelfth time washing | 8.53 | 6.50 | 6.05 | 5.60 | 5.16 | 4.70 | 4.25 | 3.79 | 3.34 | 2.88 | 2.42 | 1.95 |
| Fifteenth time washing | 8.60 | 6.63 | 6.26 | 5.88 | 5.51 | 5.13 | 4.75 | 4.37 | 3.99 | 3.60 | 3.22 | 2.83 |
| Twentieth time washing | 8.68 | 6.77 | 6.48 | 6.19 | 5.90 | 5.60 | 5.31 | 5.01 | 4.71 | 4.41 | 4.11 | 3.80 |

TABLE 2B

| | Saccharide flow rate of filtrate at each number of times of washing (t/h) | | | | | | | | Saccharide flow rate in liquid content remaining in | Saccharide |
|---|---|---|---|---|---|---|---|---|---|---|
| | Thirteenth time | Fourteenth time | Fifteenth time | Sixteenth time | Seventeeth time | Eighteenth time | Nineteenth time | Twentieth time | dehydrated cake (t/h) | recovery (%) |
| Second time washing | — | — | — | — | — | — | — | — | 3.88 | 86.2 |
| Fifth time washing | — | — | — | — | — | — | — | — | 2.60 | 90.8 |
| Tenth time washing | — | — | — | — | — | — | — | — | 1.69 | 94.0 |
| Twelfth time washing | — | — | — | — | — | — | — | — | 1.49 | 94.7 |
| Fifteenth time washing | 2.44 | 2.05 | 1.65 | — | — | — | — | — | 1.26 | 95.5 |
| Twentieth time washing | 3.50 | 3.19 | 2.88 | 2.57 | 2.26 | 1.95 | 1.64 | 1.32 | 1.01 | 96.4 |

INDUSTRIAL APPLICABILITY

The method for recovering saccharified from a saccharified slurry and the washing device of the present invention are useful in bioenergy fields as a production method and a washing device for decomposing cellulosic biomass and producing a saccharified solution.

REFERENCE SIGNS LIST

1 pressure vessel
2 flush tank
3 mixing tank
4 flocculant tank
5 residue washing device (Embodiment 1)
6 concentrating device
7 fermentation tank
8 distillation device
9 dehydrator
11 conveyor

12 net conveyor belt
13 water
14*a* to 14*e* washing water spraying unit
15*a* to 15*e* water storage tank
16*a* to 16*e* stirrer
17*a* to 17*d* piping
18 washing water tank
19 piping
20 residue
21*a*, 21*b* rotation axis
22*a* to 22*e* washing water
31 residue washing device (Embodiment 2)
32 conveyor
33 water storage tank
34*a* to 34*e* water storage trough (water storage tank)
35*a* to 35*e* sprinkling pod
36 net conveyor belt
37, 37*a* to 37*e* residue
38 piping

The invention claimed is:

1. A method for recovering saccharide from a saccharified slurry, comprising:

a washing step of feeding a saccharified slurry containing C5 saccharides or C6 saccharides obtained by subjecting a slurry of cellulosic biomass to a hot water treatment in a supercritical state or subcritical state, on a conveyor having a net conveyor belt, dehydrating the saccharified slurry and spraying washing water to a dehydrated residue on the conveyor to dissolve C5 saccharides or C6 saccharides remaining in the residue in a washing liquid, wherein the washing step washes a residue by spraying washing water to the residue from a plurality of washing water spraying units disposed in series in such a manner that the moving direction of the residue and the moving direction of the washing water are opposite to each other, and the washing water having washed the residue is used as washing water of a washing water spraying unit neighboring in the direction opposite to the moving direction of the conveyor.

2. The method for recovering saccharides from a saccharified slurry according to claim 1, further comprising an adding step of adding a flocculant to the saccharified slurry before the washing step.

3. The method for recovering saccharides from a saccharified slurry according to claim 2, wherein the net conveyor belt has a mesh ranging from 0.5 mm or more and 2.0 mm or less.

4. The method for recovering saccharides from a saccharified slurry according to claim 2, wherein the number of the washing water spraying units is five or more and twenty or less.

5. The method for recovering saccharides from a saccharified slurry according to claim 1, wherein the net conveyor belt has a mesh ranging from 0.5 mm or more and 2.0 mm or less.

6. The method for recovering saccharides from a saccharified slurry according to claim 5, wherein the number of the washing water spraying units is five or more and twenty or less.

7. The method for recovering saccharides from a saccharified slurry according to claim 1, wherein the number of the washing water spraying units is five or more and twenty or less.

8. The method for recovering saccharides from a saccharified slurry according to claim 2, wherein in the adding step, one or combination of two or more of a cationic flocculant, an anionic flocculant, a nonionic flocculant and an amphoteric flocculant is added at 0.1% by mass or more and 2% by mass or less with respect to a solid content of the saccharified slurry.

9. A washing device that washes a solid residue in a saccharified slurry containing C5 saccharides or C6 saccharides obtained by subjecting a slurry of cellulosic biomass to a hot water treatment in a supercritical state or subcritical state, the washing device comprising:

a conveyor having a net conveyor belt;

a plurality of spraying units disposed in series on the net conveyor belt; and a plurality of water storage tanks disposed below the net conveyor so that they are situated below the respective spraying units;

the washing device feeding a saccharified slurry on the net conveyor belt, dehydrating the saccharified slurry, and then spraying washing water to the residue on the net conveyor belt from the spraying unit, thereby washing the residue, wherein one of the water storage tanks is connected with one spraying unit neighboring in the direction opposite to a moving direction of the conveyor by piping, and the water storage tank stores water sprayed from the spraying unit disposed directly above, and the stored water is repeatedly used sequentially in the spraying unit neighboring in the direction opposite to the moving direction of the conveyor via a pump and piping to continuously wash the residue.

10. The washing device according to claim 9, wherein the number of the spraying units is five or more and twenty or less.

11. A washing device that washes a solid residue in a saccharified slurry containing C5 saccharides or C6 saccharides obtained by subjecting a slurry of cellulosic biomass to a hot water treatment in a supercritical state or subcritical state, the washing device comprising:

a conveyor having a net conveyor belt;

a plurality of water storage tanks; and a washing water spraying unit, the washing device feeding a saccharified slurry on the net conveyor belt, dehydrating the saccharified slurry, and then spraying washing water to the residue on the net conveyor belt, thereby washing the residue, wherein the plurality of water storage tanks are sequentially stacked at different heights in such a manner that part of the water storage tank neighboring in the direction opposite to a moving direction of the conveyor is lower, the net conveyor belt turns around so as to pass through the top face of every water storage tank from the water storage tank situated at the lowest position to the water storage tank situated at the highest position, and the plurality of water storage tanks stores washing water sprayed on the net conveyor belt from the washing water spraying unit disposed above the water storage tank situated at the highest position, and repeatedly sprays the stored washing water sequentially on the net conveyor belt above the water storage tank neighboring in the direction opposite to the moving direction of the conveyor, thereby continuously washing the residue.

12. The washing device according to claim 11, wherein the number of the plurality of water storage tanks is five or more and twenty or less.

* * * * *